United States Patent [19]

Buffaloe

[11] 4,077,539

[45] Mar. 7, 1978

[54] WIRE ADVANCING MECHANISM

[75] Inventor: Malcolm E. Buffaloe, Addison, Ill.

[73] Assignee: Microdot Inc., Greenwich, Conn.

[21] Appl. No.: 709,383

[22] Filed: Jul. 28, 1976

Related U.S. Application Data

[63] Continuation of Ser. No. 587,120, Jun. 16, 1975, abandoned.

[51] Int. Cl.[2] ..... B65H 3/06; B65H 5/06

[52] U.S. Cl. ..... 221/237; 221/261

[58] Field of Search ..... 221/236, 237, 261

[56] References Cited

U.S. PATENT DOCUMENTS

| | | | |
|---|---|---|---|
| 708,687 | 9/1902 | Winans | 221/236 |
| 3,206,065 | 9/1965 | Netta | 221/237 X |
| 3,777,932 | 12/1973 | Isamumatsui et al. | 221/236 X |

*Primary Examiner*—Robert B. Reeves
*Assistant Examiner*—Francis J. Bartuska
*Attorney, Agent, or Firm*—Harness, Dickey & Pierce

[57] ABSTRACT

A plurality of lengths of wires in a hopper are fed to a drum having spaced slots which receive the wires and advance them to a station at which a terminal is attached to the end. Difficulty is experienced when moving a length of wire from the group in the hopper and delivering it to a slot in the drum. A driven belt forms the wall at the rear of the hopper for rolling the lengths of wire downwardly about a feed wheel which has a passage thereabout defined by a face of a pawl. The bottom and outer surfaces of the pawl are urged by the ends of spring pressed plungers toward the feed wheel so as to be full-floating in the plane of the belt and laterally thereof.

3 Claims, 1 Drawing Figure

WIRE ADVANCING MECHANISM

This is a continuation of application Ser. No. 587,120, filed June 16, 1975, now abandoned.

BACKGROUND OF THE INVENTION

Reference may be had to the assignee's following patents:

3,206,065
3,245,135
3,250,870
3,264,860
3,298,217
3,310,301 which shows the most pertinent prior art known at the time of the present invention. The art which was cited in each of the above patents provides further prior art disclosures.

SUMMARY OF THE INVENTION

A plurality of wires are placed in a hopper and are positively fed downwardly by a resilient, positive feed, belt forming a portion of the side wall of the hopper and driven by a constant speed motor. The wires are engaged by a feed wheel of elastomeric material so as to be moved downwardly from an opening at the bottom of the hopper into complimentary slots in a feed drum. The opening at the bottom of the hopper communicates with the top opening of a feed channel defined by the feed wheel and an arcuate face of a floating feed pawl. The feed pawl is free to move upwardly and downwardly and outwardly and inwardly. This movement is permitted and controlled by a plurality of spring biased pins encased in threaded containers. The pins are adjustably mounted so as to engage the outer and bottom surfaces of the feed pawl. In this manner, variations in wire diameter, wire roundness, and bends in the wire are accommodated. The wires are held within the peripheral slots in the drum by a shroud and carried circumferentially to a prepositioning station where the wire is moved longitudinally in the slot to a predetermined position. As the drum is advanced to a terminal attaching station, the wire is further advanced in the slot so to be in a fixed position to have a terminal crimped thereto and to the adjacent insulating material. The terminal is severed from a carrying strip substantially simultaneous with crimping of the terminal about the wire. Attention is drawn to the assignee's patent to L. A. Netta et al, No. 3,245,135, which issued Apr. 12, 1966 and over which the present invention is an improvement, and which will be referred to hereafter as "said patent".

DESCRIPTION OF THE PREFERRED EMBODIMENT

Figure 1:
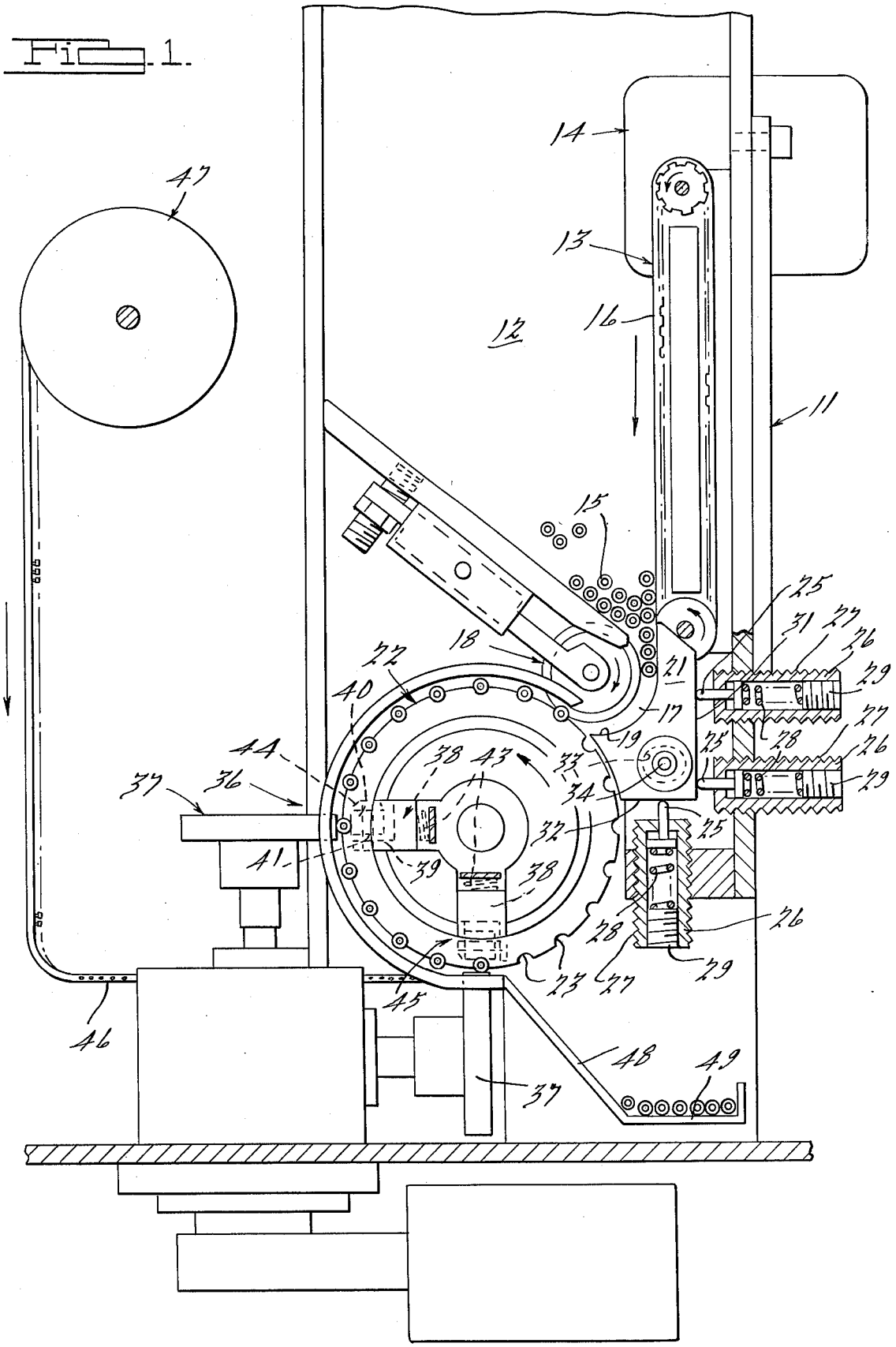
FIG. 1 is an end view of the mechanism for positively advancing prepared insulated wires of predetermined lengths to spaced slots in the periphery of a wire feeding drum embodying features of the present invention.

In the Figure, a machine 11 is similar to the machine illustrated and described in "said patent" which prepares a group of wires so that they may be advanced to two stations, one a prepositioning station, the other a station where a terminal is applied to the end of the wire. The standard type of terminal applying machine is employed, comprising a ram which reciprocates upwardly and downwardly. The present invention comprises an improved hopper 12, a portion of one wall of which is formed by a continuous, positive feed, resilient, gear type belt 13 which is driven at a predetermined speed by a motor 14. A plurality of insulated wires 15 are placed within the hopper 12 so as to be advanced by gravity against the face 16 of the belt 13. The wires 15 have at least one end stripped of insulation so that a terminal may be crimped thereon.

An opening adjacent the bottom end of the belt 13 is aligned with an arcuate channel 17 which extends downwardly and is defined by the outer periphery of a feed wheel 18 and an arcuate face 19 of a floating escapement pawl 21. The upstroke of the ram turns a wire feed drum 22 through a ratchet mechanism, similar to that shown in said patent, a distance equal to the distance between peripheral slots 23 into which the wires 15 are delivered. The feed wheel 18 is made of an elastomeric material of medium durometer and is in driver engagement with the wire feed drum 22. The feed drum 22 is disposed at the end of the converging slot 17 in generally tangential relationship. The wires 15 are sequentially advanced into the channel 17 by the face 16 of the gear belt 13. The wires are subsequently advanced through the slot 17 between the feed wheel 18 and the face 19 of the escapement pawl 21. The slots 23 in the feed drum 22 are equally circumferentially spaced a distance equal to the distance the periphery of the drum 22 is advanced upon each upstroke of the machine operating through a ratchet mechanism of a type not herein illustrated, but which would follow the teaching illustrated and described in "said patent".

In accordance with another feature of the instant invention, the escapement pawl 21 is urged vertically and horizontally toward the feed wheel 18 by spring loaded pins 25. The pins 25 are mounted within containers 26 having an external thread 27 for engagement in the threads of complimentary apertures in a support. The containers 26 can be adjusted inwardly and outwardly relative to the support. The heads of the pins 25 are urged toward the pawl 21 by springs 28 located between the heads and internally threaded bias adjustment screws 29. The pins 25 bias the pawl 21 against the wires and permit it to float downwardly, inwardly and outwardly and assume various angular positions as the wires feed through the channel 17. The degree of movement of the pawl 21 is limited by an oval aperture 33 in the pawl which accepts a screw 34 for retention of the pawl 21.

The captured wires 15 are advanced each time the ram of the machine moves upwardly until a wire 15 reaches a prepositioning station 36 where a drive wheel 37, which is similar to the drive wheel of "said patent", engages the insulation of the wire and urges it against a wire feed back-up unit 38. The back-up unit 38 comprises a radially moveable holder 39 for a roller 40. The roller 40 is mounted on a shaft 41 and is urged toward the wire 15 by a spring 43. The leading edge of the roller 40 is chamfered to define a truncated conical surface 44 to minimize bumping which would otherwise occur if the roller struck the metal between the slots 23.

The prepositioning station 36 is located at nine o'clock, while a terminal applying station 45 is located at six o'clock. The terminal application station has a similar drive wheel 37 and backup unit 38 located thereat for further advancing the prepositioned wire to an exact location relative to a terminal to be crimped thereto.

The terminals have ear portions which, upon downward movement of the machine ram, are folded over the stripped end portion of the conductor and additional ear portions which are folded over the insulating material adjacent thereto. The terminals are all connected together on a carrier strip 46 which is delivered from a feed drum 47. The terminals are cut from the strip 46 at the station 45 as the terminal is crimped. The wire then ejects and is permitted to slide down a sloping ramp 48 into a collecting bin 49.

Applicant has provided an improved hopper with a downwardly movable wall portion which positively advances insulated wire downwardly into an arcuate feed channel 17. The feed channel is defined by the periphery of the elastomeric feed wheel 18 and an arcuate face on the floating escapement pawl 21. The escapement pawl 21 is made of fluoropolymer material which has a low coefficient of friction as compared to the elastomeric material from which the drive wheel 18 is constructed. This permits sliding of the wires along the arcuate face 19 of the pawl 21 when urged by friction engagement with the feed wheel 18. The aforesaid arrangement assures the proper delivery of wires to each of the slots 23 of the feed drum 22 as it is advanced.

I claim:

1. A mechanism for advancing wires from a hopper to a terminal application station of a terminal crimping machine including a hopper for holding a plurality of wires, a continuous resilient belt forming a substantially vertical portion of one wall of the hopper, means for driving said belt with the inwardly disposed substantially vertical face thereof moving downwardly toward a bottom opening in said hopper through which wires from within the hopper are advanced by the action of the downward movement of said belt, a feed wheel cooperating with said belt for advancing the wires in said opening, a floating escapement pawl having an arcuate portion spaced from the periphery of said feed wheel so as to form a variable channel in communication with said hopper and through which said wires are advanced to said feed drum, and means for resiliently supporting said pawl in a manner to permit it to move in any direction parallel to its plane to vary the width of the channel, said resilient supporting means comprising spring pressed pins disposed in contact with said pawl for supporting said pawl in operable position on at least two sides thereof.

2. A mechanism for advancing wires as recited in claim 1, wherein each said pin is mounted in a separate container, means for mounting said containers at fixed spaced positions, a spring in each said container engaging the inner end of the pin therein for urging the pin outwardly of each said container end so that a plurality of said pins engage and support said pawl.

3. A mechanism for advancing wires as recited in claim 2, wherein a threaded plug is screwed into the outer ends of each of said containers for changing the pressure on said springs and pins for controlling the direction of movement of said pawl when wires are passed through the channel formed thereby about said feed wheel.

* * * * *